US010762816B2

(12) United States Patent
Lee et al.

(10) Patent No.: US 10,762,816 B2
(45) Date of Patent: Sep. 1, 2020

(54) DISPLAY DEVICE AND DRIVING METHOD THEREOF

(71) Applicant: SAMSUNG DISPLAY CO., LTD., Yongin-Si, Gyeonggi-Do (KR)

(72) Inventors: Jae Han Lee, Yongin-si (KR); Myeong Su Kim, Yongin-si (KR); Sun Koo Kang, Yongin-si (KR); Bo Yeon Kim, Yongin-si (KR); Dong Won Park, Yongin-si (KR); Tae Gon Im, Yongin-si (KR); Jung Hwan Cho, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 42 days.

(21) Appl. No.: 16/045,918

(22) Filed: Jul. 26, 2018

(65) Prior Publication Data

US 2019/0147831 A1 May 16, 2019

(30) Foreign Application Priority Data

Nov. 15, 2017 (KR) ..... 10-2017-0152545

(51) Int. Cl.
*G09G 3/20* (2006.01)
*G09G 5/00* (2006.01)

(52) U.S. Cl.
CPC ..... *G09G 3/20* (2013.01); *G09G 5/008* (2013.01); *G09G 2310/0243* (2013.01); *G09G 2310/0264* (2013.01); *G09G 2330/06* (2013.01); *G09G 2370/08* (2013.01)

(58) Field of Classification Search
CPC ..... G09G 5/008
See application file for complete search history.

(56) References Cited

U.S. PATENT DOCUMENTS

| | | | | |
|---|---|---|---|---|
| 9,331,873 | B2 * | 5/2016 | Lee | H04L 25/0272 |
| 9,390,670 | B2 * | 7/2016 | Lee | G09G 3/3648 |
| 9,449,577 | B2 * | 9/2016 | Yang | G09G 5/006 |
| 9,589,524 | B2 * | 3/2017 | Park | G09G 3/3685 |
| 10,217,395 | B2 * | 2/2019 | Ha | G09G 3/2092 |
| 10,249,258 | B2 * | 4/2019 | Park | G09G 5/008 |

(Continued)

FOREIGN PATENT DOCUMENTS

| | | |
|---|---|---|
| KR | 101397007 | 5/2014 |
| KR | 1020140077608 | 6/2014 |

*Primary Examiner* — Patrick F Marinelli
(74) *Attorney, Agent, or Firm* — F. Chau & Associates, LLC

(57) ABSTRACT

A display device may include a timing controller, a data driver and a plurality of pixels. The timing controller supplies a clock training pattern over a data/clock signal line in a first time period, and supplies pixel/control data over the data/clock signal line in a second time period. The data driver generates a clock signal, using the clock training pattern, in the first period, and generate a plurality of data voltages based on the plurality of pixel data, using the clock signal, in the second period. The plurality of pixels receive the plurality of data voltages and emit corresponding light. During the second period, the data driver outputs a feedback signal to the timing controller indicating that the locking of the clock signal has failed. The timing controller re-supplies the clock training pattern in response to the feedback signal.

19 Claims, 8 Drawing Sheets

(56) References Cited

U.S. PATENT DOCUMENTS

| | | | | |
|---|---|---|---|---|
| 10,319,286 | B2 * | 6/2019 | Do | G09G 3/2096 |
| 2015/0187315 | A1 * | 7/2015 | Park | G09G 3/3685 345/99 |
| 2015/0206492 | A1 * | 7/2015 | Lee | G09G 3/3648 345/208 |
| 2015/0310824 | A1 * | 10/2015 | Yang | G09G 5/006 345/213 |
| 2016/0351129 | A1 * | 12/2016 | Kim | G09G 3/3258 |
| 2017/0132966 | A1 * | 5/2017 | Lim | G09G 3/2092 |
| 2017/0193892 | A1 * | 7/2017 | Ha | G09G 3/2092 |
| 2018/0114483 | A1 * | 4/2018 | Kim | G09G 3/2003 |
| 2018/0122294 | A1 * | 5/2018 | Do | G09G 3/3225 |
| 2018/0190238 | A1 * | 7/2018 | Park | G09G 5/008 |
| 2019/0073075 | A1 * | 3/2019 | Cho | G09G 3/3648 |
| 2019/0121476 | A1 * | 4/2019 | Jang | G06F 3/0412 |
| 2019/0129564 | A1 * | 5/2019 | Kim | G06F 3/04166 |
| 2019/0147830 | A1 * | 5/2019 | Pyun | G09G 5/008 |
| 2019/0147831 | A1 * | 5/2019 | Lee | G09G 5/008 |

* cited by examiner

DISPLAY DEVICE AND DRIVING METHOD THEREOF

CROSS-REFERENCE TO RELATED APPLICATION

The present application claims priority under 35 U.S.C. § 119(a) to Korean patent application 10-2017-0152545 filed on Nov. 15, 2017 in the Korean Intellectual Property Office, the entire disclosure of which is incorporated herein by reference.

BACKGROUND

1. Technical Field

The inventive concept relates generally to a display device and a driving method thereof, and more particularly, to clock recovery in a display device.

2. Discussion of Related Art

Display devices such as liquid crystal displays (LCDs) and organic light emitting displays (OLEDs) have become ubiquitous. A modern display device displays a target image by writing a "data voltage" for expressing a target gray scale in each pixel, where the data voltage is typically one of $2^N$ levels, e.g. one of 256 gray levels for N=8. In the case of an OLED display pixel, the data voltage causes an organic light emitting diode to emit light, and in the case of an LCD display pixel, light of a backlight unit is polarized by controlling orientation of liquid crystals, corresponding to the data voltage.

The data voltage is generated from a data driver. For the data driver to stably generate a plurality of data voltages, there should be accurate sampling of a plurality of pixel data (supplied from a timing controller) using a clock signal.

In some displays, the clock signal is not supplied from the timing controller, to avoid the necessity of an additional data line and the potential generation of unwanted electromagnetic (EM) noise. Instead, the data driver may recover a clock signal from a clock training pattern (CTP) signal intermittently supplied on the same data line as pixel data from the timing controller, using a clock data recovery circuit (CDR circuit). With a properly operating CDR circuit, the generated (i.e., recovered) clock signal may be said to be "locked" when pixel data supplied from the timing controller is synchronized with the clock signal. This allows for accurate generation of the data voltages based on correctly extracted pixel data. When the locking of the clock signal is said to be "released" of "the locking falls", synchronization is lost such that the correct data voltages are no longer applied to the pixels, resulting in a display defect.

SUMMARY

The present inventive concept recognizes that existing CDR circuits operate only during a vertical blanking period in which a clock training pattern is supplied, but do not operate during an active data period in which a plurality of pixels emit light. As a result, a display defect occurs when the locking of a clock signal is released due to an electrostatic discharge (ESD) stress or other catalyst during the active data period. A problem arises in that the display defect continues until a next clock training pattern is supplied.

Embodiments of the inventive concept provide a display device and driving method capable of immediately recovering a clock signal when the locking of the clock signal falls, during not only a vertical blank period but also during an active data period.

According to an aspect of the present inventive concept, a display device includes a timing controller, a data driver and a plurality of pixels. The timing controller is configured to supply a clock training pattern through a data/clock signal line in a first time period, and supply a plurality of pixel data and data control signals through the data/clock signal line in a second time period. The data driver is configured to generate a clock signal, using the clock training pattern, in the first period, and generate a plurality of data voltages based on the plurality of pixel data, using the clock signal, in the second period. The plurality of pixels receive the plurality of data voltages and emit corresponding light. During the second period, the data driver outputs a feedback signal to the timing controller indicating that the locking of the clock signal has failed. The timing controller re-supplies the clock training pattern in response to the feedback signal.

The data driver may generate a plurality of phase signals each having a frequency corresponding to that of the clock training pattern in the first period, and generate the clock signal, using the plurality of phase signals.

The data driver may detect whether the locking of the clock signal has failed, using a first phase signal having a phase corresponding to that of the clock training pattern among the plurality of phase signals in the second period.

The plurality of pixel data and the plurality of data control signals may be organized in unit data blocks and include a transition bit for each unit data block. The period of the unit data block may correspond to that of the first phase signal.

The data driver may detect whether the locking of the clock signal has failed by detecting whether the transition time of the transition bit corresponds to that of the first phase signal.

The data driver may include a lock detector coupled to a feedback line carrying the feedback signal in the first period. The lock detector may provide the feedback signal during the first period at a level indicative of whether the clock signal has locked. An edge detector may be coupled to the feedback line in the second period, where the edge detector provides the feedback signal during the second period at a level indicative of whether the clock signal has locked.

The data driver may further include a voltage controlled oscillator configured to generate a plurality of phase signals each having a frequency corresponding to that of the clock training pattern in the first period, and generate the clock signal, using the plurality of phase signals.

The data driver may further include: a phase frequency detector configured to generate a first up signal or a first down signal by comparing at least one of the plurality of phase signals with the clock training pattern; and a phase detector configured to generate a second up signal or a second down signal by comparing the clock signal with the plurality of pixel data and the plurality of data control signals.

The data driver may further include a multiplexer configured to selectively output one of an output signal of the phase frequency detector and an output signal of the phase detector according to an output signal of the lock detector.

The data driver may further include a charge pump configured to increase the supply of charges according to the first and second up signals output from the multiplexer, and decrease the supply of charges according to the first and second down signals output from the multiplexer.

The data driver may further include a loop filter configured to generate a control voltage according to the supply of charges. The voltage controlled oscillator may generate the plurality of phase signals according to the control voltage.

During the second time period, the following may occur: in response to the feedback signal, the timing controller suspends the supply of the plurality of pixel data and data control signals and re-supplies the clock training pattern; the data driver re-generates the clock signal based on the re-supplied clock training pattern and outputs the feedback signal at a different voltage level back to the timing controller, the different voltage level representing that the locking of the clock signal has succeeded; and the timing controller resumes the supply of the plurality of pixel data and data control signals in response to receiving the feedback signal at the different voltage level.

The first time period may be a vertical blanking period (VBP) of a frame and the second time period may be an active data period (ADP) of the frame.

According to an aspect of the inventive concept, an analogous method for driving a display device is provided.

In another aspect of the inventive concept, display device circuitry includes a timer controller circuit and a data driver circuit. The timing controller circuit is configured to supply a clock training pattern through a first signal line during a first time period, and to supply a plurality of pixel data through the first signal line during a second time period. The data driver circuit is configured to generate a clock signal, using the clock training pattern in the first period, continue to generate the clock signal in a second period, and generate a plurality of data voltages to be output to a plurality of pixels, based on the plurality of pixel data using the clock signal in the second period. During the second period: the data driver circuit outputs a feedback signal to the timing controller circuit indicating the clock signal is not synchronized with the pixel data, and the timing controller circuit re-supplies the clock training pattern in response to the feedback signal.

BRIEF DESCRIPTION OF THE DRAWINGS

The above and other aspects and features of the inventive concept will become more apparent from the following detailed description, taken in conjunction with the accompanying drawings in which like reference numerals indicate like elements or features, wherein.

DETAILED DESCRIPTION

Example embodiments will now be described more fully hereinafter with reference to the accompanying drawings. The inventive concept, however, may be embodied in different forms and should not be construed as limited to the embodiments set forth herein.

It will be understood that when an element is referred to as being "between" two elements, it can be the only element between the two elements, or one or more intervening elements may also be present. It will be understood that, although the terms "first", "second", etc. may be used herein to describe various elements, these elements should not be limited by these terms. These terms are only used to distinguish one element from another element. As used herein, singular forms are intended to include the plural forms as well, unless the context clearly indicates otherwise.

It will be further understood that the terms "Includes" and/or "including", when used in this specification, specify the presence of stated features, integers, steps, operations, elements, and/or components, but do not preclude the presence and/or addition of one or more other features, integers, steps, operations, elements, components, and/or groups thereof.

Figure 1:
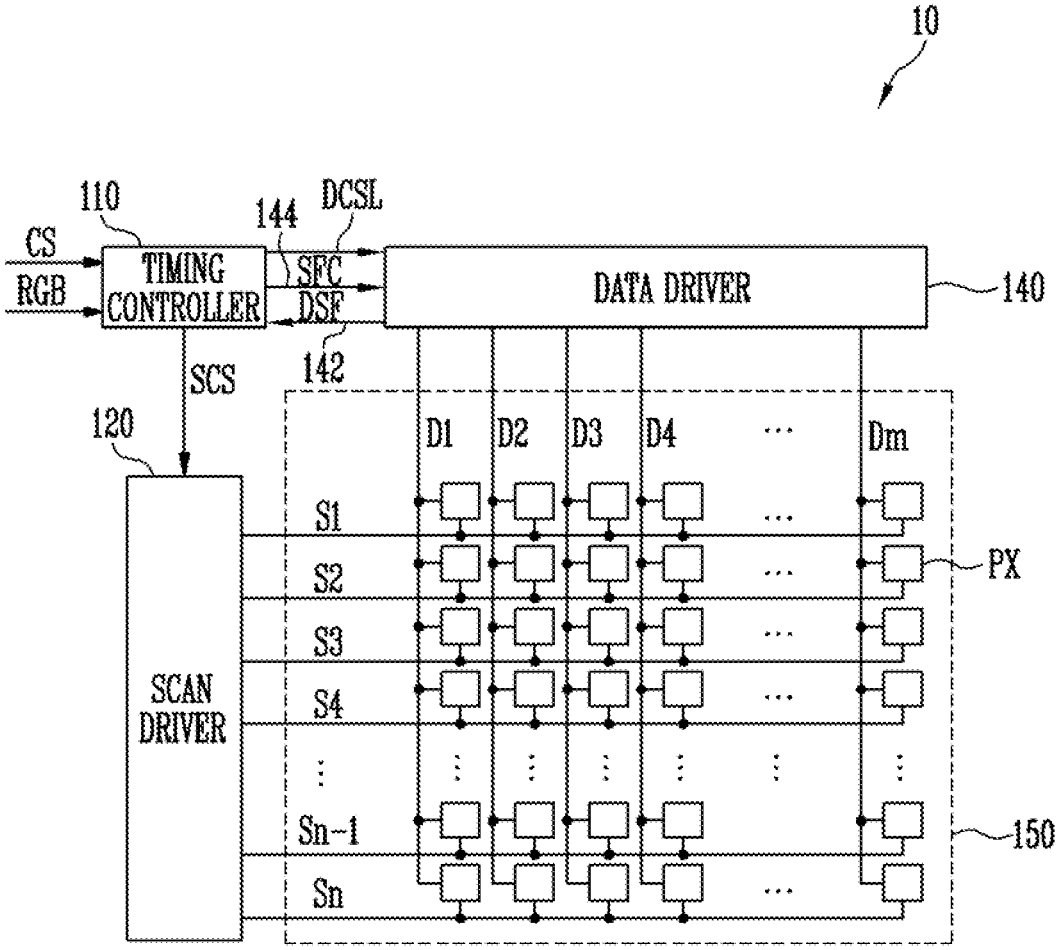
FIG. 1 is a diagram illustrating a display device according to an embodiment of the present inventive concept.

FIG. 1 is a diagram illustrating an example display device, 10, according to an embodiment of the inventive concept. Display device 10 may include a pixel unit (interchangeably, "a plurality of pixels") 150, a timing controller 110, a scan driver 120, and a data driver 140.

The timing controller 110 may supply a clock training pattern (CTP) signal through a "data/clock signal line" DCSL during a first time period. As mentioned earlier, a CTP signal may be advantageously transmitted to avoid the addition of a dedicated clock line between a timing controller and a data driver. During a second time period following the first time period, timing controller 110 may supply a plurality of pixel data and a plurality of data control signals through the data/clock signal line DCSL. Accordingly, the data/clock signal line DCSL may be understood as a data line over which a CTP signal, and a data signal carrying pixel data, are transmitted during different time periods. An example of the first time period is a vertical blanking period (VBP) of a frame, and an example of the second time period is an active data period (ADP) of the frame. Other types of time periods are contemplated. The data/clock signal line DCSL, although referred to herein as a "line", may be embodied as a plurality of parallel data lines, where each of the parallel data lines carries pixel/control data and a CTP signal for one or more driver units of data driver 140 (discussed later).

Specifically, the timing controller 110 may convert an external image signal RGB input from an external source into pixel data suitable for the data driver 140, and supply the pixel data to the data driver 140 during the second period. Data driver 140 derives a clock signal based on the CTP signal, where the clock signal is generated to have a frequency matching a bit frequency of the pixel data. Thus, during the second time period, the clock signal is used to sample each bit of the pixel data to generate gray scale-based data voltages for the respective pixels.

Also, the timing controller 110 may generate a scan control signal SCS for controlling the scan driver 120 and a data control signal for controlling the data driver 140 by using an externally provided control signal CS. The data control signal may be supplied to the data driver 140 through the data/clock signal line DCSL in the second period. It is noted here that timing controller 110 may form or be part of an integrated circuit. Timing controller 110 may be interchangeably referred to as a timing controller circuit, circuitry, hardware, or the like.

The first period and the second period may be non-overlapping time periods. As mentioned, the first period may be a vertical blank period (VBP), and the second period may be an active data period (ADP). The ADP may be a period in which pixel data corresponding to an image frame displayed by the pixel unit 150 is supplied, and the VBP may be a transitional period between a current frame and a next frame, in which the pixel data is not supplied. In related art display devices discussed earlier, clock training is performed in only the VBP. As explained further below, in accordance with the inventive concept, during the second period, when an electrostatic discharge or other catalyst causes the clock signal to become unlocked (i.e., "fail") such that pixel data cannot be properly read, data driver 140 may notify timing controller 110 of this condition through a feedback signal. Timing controller 110 may then respond by immediately sending the clock training pattern, instead of the pixel data, to allow data driver 140 to immediately recover the clock.

Timing controller 110 may supply a clock training notification signal SFC (hereafter, just "SFC signal") on a dedicated control line 144, where the SFC signal has a value representing whether the clock training pattern is to be supplied. During the first period, to notify data driver 140 that the clock training pattern is to be supplied, the SFC signal may be a first-level notification signal (e.g. a logic low or a logic high). When the clock training pattern is not supplied, the clock training notification signal SFC may be a second-level notification signal (e.g. a logic high or a logic low, opposite to the first-level).

The data driver 140 may generate a clock signal, using the clock training pattern, in the first period, and generate a plurality of data voltages by extracting a plurality of pixel data, using the clock signal, in the second period (the clock signal continues to be generated in the second period).

The data driver 140 according to this embodiment may send a feedback signal DSF on a feedback line 142 to the timing controller 110, where the feedback signal DSF indicates whether the locking of the clock signal has failed. As mentioned, if the locking of the clock signal has failed, this signifies that the clock signal is not synchronized (or will not be synchronized) with the pixel data, such that a satisfactory reading of the pixel data cannot be made. In the second period, if the feedback signal DSF indicates that the locking of the clock signal has failed, the timing controller 110 may immediately re-supply the clock training pattern. Thus, according to this embodiment, the display device 10 can immediately recover the clock signal when the locking of the clock signal fails during not only the VBP but also during the ADP.

Figure 2:
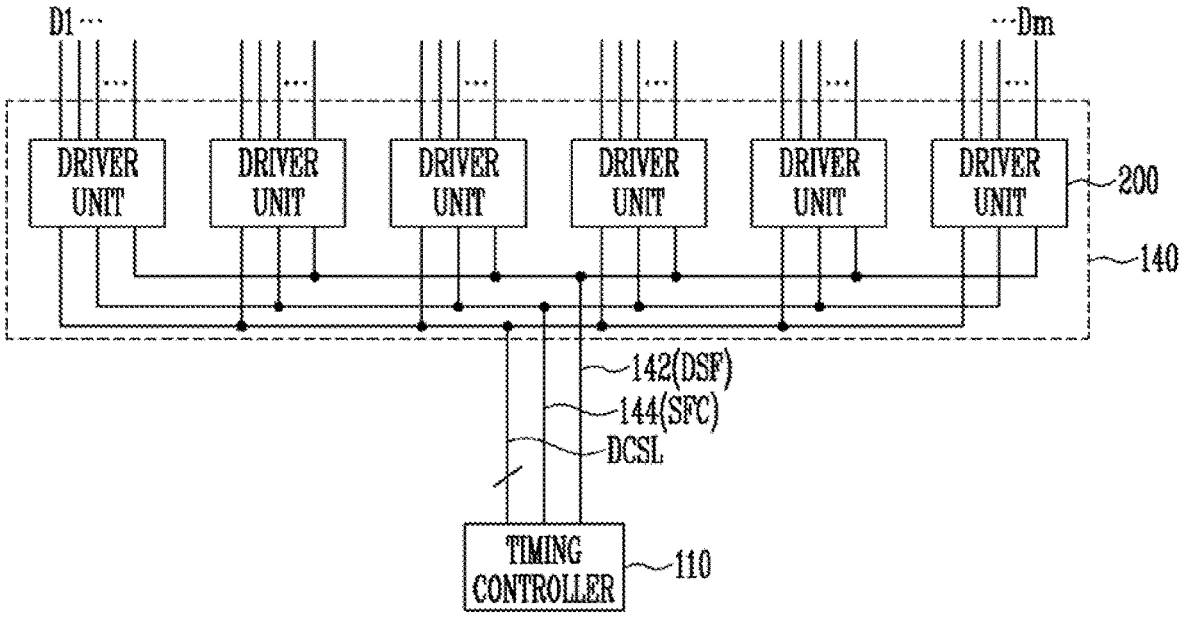
FIG. 2 is a diagram illustrating a data driver according to an embodiment of the inventive concept.

Data driver 140 may be comprised of multiple driver units 200 (shown in FIG. 2). In some embodiments, the data driver 140 may transmit information on each driver unit 200 to the timing controller 110 through the feedback line 142. The information on each driver unit 200 may include information on temperature, an integrated circuit (IC) manufacturer, an output delay, a slew rate, etc. The data driver 140 may time-divisionally transmit the information on each driver unit 200 and whether the locking of the clock signal has failed in each driver unit 200 to the timing controller 110 through the feedback line 142.

The data driver 140 may apply the plurality of generated data voltages to a plurality of data lines D1, D2, D3, D4, . . . , and Dm.

The scan driver 120 may supply a plurality of scan signals to a plurality of scan lines S1, S2, S3, S4, . . . , Sn−1, and Sn in response to the scan control signal SCS. For example, the scan driver 120 may sequentially supply the scan signals to the plurality of scan lines S1, S2, S3, S4, . . . , Sn−1, and Sn.

The pixel unit 150 may include a plurality of pixels PX that each emits light at a gray-scale based intensity corresponding to one of the data voltages applied thereto. That is, each of the plurality of pixels PX may be coupled to a corresponding data line among the data lines D1, D2, D3, D4, . . . , and Dm and a corresponding scan line among the scan lines S1, S2, S3, S4, . . . , Sn−1, and Sn, and be supplied with a data voltage and a scan signal through the corresponding data line and the corresponding scan line. When the display device 10 is an organic light emitting display device, each pixel PX may include an organic light emitting diode. When the display device 10 is a liquid crystal display device, each pixel PX may include a liquid crystal layer. For instance, data driver 140 may generate each data voltage as a gray scale voltage from n bits of pixel data. If n=8 (8-bit pixel data), there may be $2^8$=256 possible values for any data voltage; if n=16 there may be $2^{16}$=65,536 possible values for any data voltage, etc. The pixels PX may each be alternatively referred to as sub-pixels, each used for a particular hue, e.g., R, G or B, where a set of three adjacent sub-pixels for R, G and generates a composite color for the collective pixel region of the sub-pixels. Any pixel PX may alternatively be a monochrome pixel.

FIG. 2 is a diagram illustrating an example data driver 140 according to an embodiment of the inventive concept. In this example, data driver 140 includes a plurality of driver units 200. Each driver unit 200 is comprised of circuitry and may alternatively be referred to herein as a driver circuit, a driver integrated circuit (IC) or a source IC. (Data driver 140 may likewise be called a data driver circuit.)

The plurality of driver units 200 may use the feedback line 142 carrying the DSF signal as a common bus line, and use the clock training notification line 144 carrying the SFC signal as a common bus line. For example, the timing controller 110 may simultaneously transfer a notification signal notifying that a clock training pattern is to be supplied to all of the driver units 200 through the clock training notification line 144.

Also, for example, the plurality of driver units 200 may send information on each driver unit or the DSF signal for each driver unit (indicating whether the locking of a clock signal has failed for that driver unit) time-divisionally to the timing controller 110 through the feedback line 142. Which driver unit 200 is to "occupy" the feedback line 142 (i.e., send its signal on feedback line 142) and at which time a particular driver unit 200 is to occupy the feedback line 142 may be previously set in a data control signal supplied from the timing controller 110.

In the example of FIG. 2, the data/clock signal line DCSL is formed as multiple, parallel data lines (hereafter the multiple lines may be collectively referred to as "DCSL lines" while a single one of the DCSL lines will be referred to as a "DCSL line", for brevity). Each of the plurality of driver units 200 may be coupled to the timing controller 110 through the DCSL lines. At least one of the DCSL lines may be provided for each driver unit 200. For example, when the bandwidth using a single DCSL line is insufficient, a plurality of DCSL lines may be provided for each driver unit 200 so as to supplement the insufficient bandwidth. In addition, even when the dedicated data/clock signal line DCSL is configured as a differential signal line so as to remove common mode noise, each driver unit 200 may connect to at least two differential DCSL lines (at least four individual lines).

Figure 3:
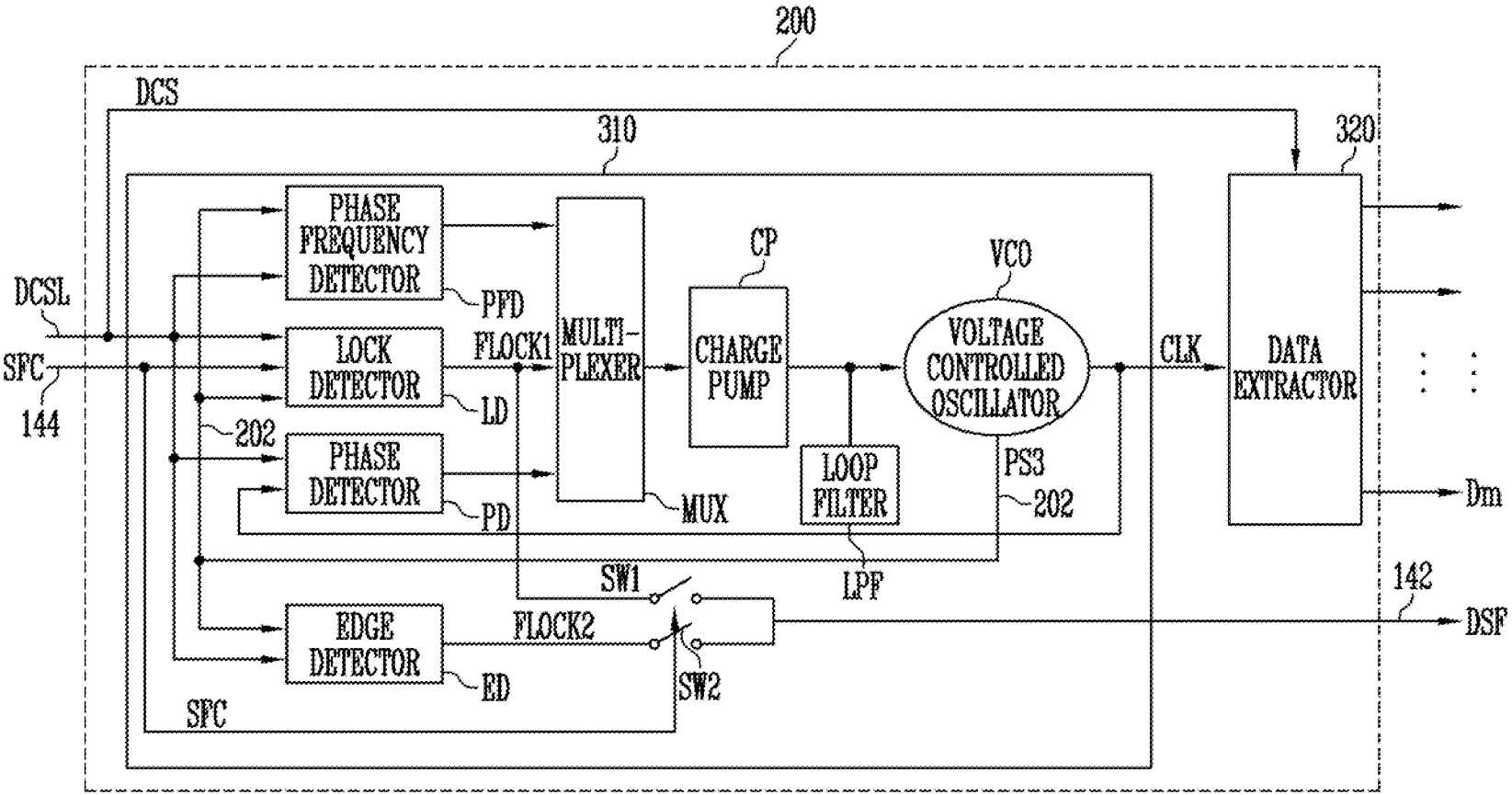
FIG. 3 is a diagram illustrating a driver unit according to an embodiment of the inventive concept.
Figure 4:
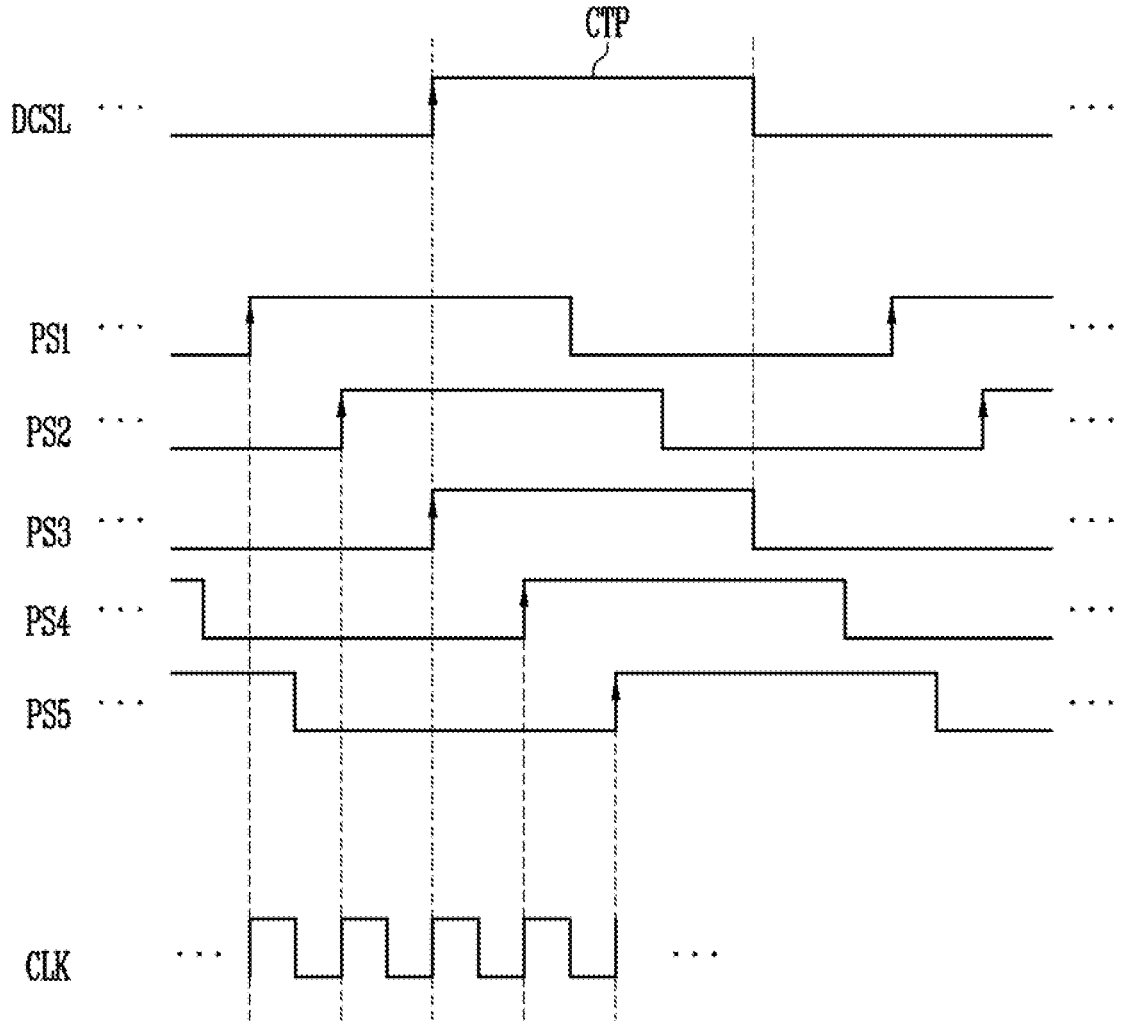
FIG. 4 is a diagram illustrating an operation of a voltage controlled oscillator according to an embodiment of the inventive concept.

FIG. 3 is a diagram illustrating an example driver unit 200 according to an embodiment of the inventive concept. FIG. 4 is a diagram illustrating an operation of a voltage controlled oscillator according to an embodiment of the inventive concept.

Referring to FIG. 3, each driver unit 200 may include a clock signal generator 310 and a data extractor 320.

The data extractor 320 may generate a plurality of data voltages by sampling a plurality of pixel data supplied through the data/clock signal line DCSL, using a clock signal CLK generated from the clock signal generator 310, and supply the generated data voltages to the pixel unit 150.

The clock signal generator 310 may include a phase frequency detector PFD, a lock detector LD, a phase detector PD, an edge detector ED, a multiplexer MUX, a charge pump CP, a loop filter LPF, and a voltage controlled oscillator VCO. The clock signal generator 310 may be a clock data recovery (CDR) circuit.

The lock detector LD may be coupled to the feedback line 142 through a switch SW1 (in a closed state) in the first period and output a signal representing whether the clock signal CLK has locked. For example, if a first-level notification signal (e.g. the SFC signal is logic low) is supplied through the clock training notification line 144 during a period in which a clock training pattern is supplied in the first period, a current flows through a switch SW1 between the lock detector LD and the feedback line 142, so that an output signal FLOCK1 of the lock detector LD is transferred to the timing controller 110 as the feedback signal DSF through the feedback line 142. (As illustrated, the SFC signal may control the switching state of switch SW1.) For example, when the output signal FLOCK1 has a first level, the output signal FLOCK1 may indicate that the locking of the clock signal CLK has failed. When the output signal FLOCK1 has a second level, the output signal FLOCK1 may indicate that the locking of the clock signal CLK has succeeded.

The edge detector ED may be coupled to the feedback line 142 in the second period and output a signal representing whether the clock signal CLK has locked. For example, a second-level notification signal (e.g. the SFC signal is logic high) may be supplied through the clock training notification line 144 in the second period in which the clock training pattern is not supplied. At this time, a current flows through a switch SW2 between the edge detector ED and the feedback line 142, so that an output signal FLOCK2 of the edge detector ED is transferred to the timing controller 110 as the feedback signal DSF through the feedback line 142. (As illustrated, the SFC signal may control the switching state of switch SW2.) For example, when the output signal FLOCK2 has the first level, the output signal FLOCK2 may indicate that the locking of the clock signal CLK has failed. When the output signal FLOCK2 has the second level, the output signal FLOCK2 may indicate that the locking of the clock signal CLK has succeeded.

The voltage controlled oscillator VCO ("the VCO") may generate a plurality of phase signals having a frequency corresponding to that of the clock training pattern in the first period, and generate the clock signal CLK, using the plurality of phase signals. Referring to FIG. 4, the VCO may generate a plurality of phase signals PS1, PS2, PS3, PS4, and PS5 each having a frequency corresponding to that of the clock training pattern CTP, and generate the clock signal CLK which is a relatively high frequency signal by combining or sequentially using the plurality of phase signals PS1, PS2, PS3, PS4, and PS5 that are relatively low frequency signals.

In FIG. 4, it is illustrated five phase signals PS1, PS2, PS3, PS4, and PS5 are used, but the number of phase signals may differ in other embodiments. For example, ten or more phase signals may be used. In the example illustrated, the generated (recovered) clock signal CLK has a frequency n times higher than the CTP signal, where n=4. In other cases, the CLK signal may be generated at higher or lower multiples of the CTP signal frequency.

One phase signal, PS3, of the plurality of phase signals PS1, PS2, PS3, PS4, and PS5 may have a phase equal to or substantially equal to that of the clock training pattern CTP. As shown in FIG. 3, the phase signal PS3 is output by the VCO on a line 202, and may be referred to as a "first phase signal". The first phase signal PS3 may be a signal having a phase most similar to that of the clock training pattern CTP among the plurality of phase signals PS1, PS2, PS3, PS4, and PS5. (Thus, any one of the phase signals PS1 to PS5 with the closest phase may wind up being the "first phase signal".)

Returning to FIG. 3, the edge detector ED may detect whether the locking of the clock signal CLK has failed, using the first phase signal PS3, in the second period. A plurality of pixel data and a plurality of data control signals, which are supplied through the data/clock signal line DCSL in the second period, may include a transition bit for each unit data block. The period of the unit data block may correspond to that of the first phase signal PS3. The unit data block and the transition bit will be described later with reference to FIGS. 6 and 7. The edge detector ED detects whether the transition time of the transition bit corresponds to that of the first phase signal CS3, thereby detecting whether the locking of the clock signal CLK has failed.

The phase frequency detector PFD ("the PFD") may be a type of phase detector that produces an output when two signals being compared differ in frequency and/or phase (rather than just phase). The PFD may generate a first up signal or a first down signal by comparing at least one of the plurality of phase signals PS1, PS2, PS3, PS4, and PS5 with the clock training pattern CTP ("CTP signal"). (Although the signal PS3 is shown output by the VCO on line 202, it is understood that any of the phase signals PS1 to PS5 may be output on line 202 and fed back to the PFD to be compared with the CTP signal.) The CTP signal may be supplied through the data/clock signal line DCSL in the first period. Subsequently, the plurality of pixel data and the plurality of data control signals may be supplied in the second period, but an output of the phase frequency detector PFD according to the plurality of pixel data and the plurality of data control signals does not pass through the multiplexer MUX ("the MUX").

The phase detector PD may generate a second up signal or a second down signal by comparing the clock signal CLK with the plurality of pixel data and the plurality of data control signals. The plurality of pixel data and the plurality of data control signals may be supplied through the data/clock signal line DCSL in the second period. Subsequently, the clock training pattern CTP may be supplied through the data/clock signal line DCSL in the first period, but an output of the phase detector PD according to the clock training pattern CTP does not pass through the MUX.

The MUX selectively outputs one of an output signal of the phase frequency detector PFD and an output signal of the phase detector PD according to the output signal FLOCK1 of the lock detector LD. For example, when the lock detector LD outputs the output signal FLOCK1 having the first level, which indicates that the locking of the clock signal CLK has failed, the MUX may output the output signal of the PFD by closing a circuit path from an output terminal of the PFD to an output terminal of the MUX. For example, when the lock detector LD outputs the output signal FLOCK2 having the second level, which indicates that the locking of the clock signal CLK has succeeded, the MUX may output the output of the phase detector PD by closing a circuit path from an output terminal of the phase detector PD to the MUX output terminal.

The charge pump CP may increase the supply of charges according to the first and second up signals output from the MUX, and decrease the supply of charges according to the first and second down signals output from the MUX.

The loop filter LPF may include, for example, a capacitor. In this case, a control voltage versus ground is generated at one end of the capacitor according to a quantity of charges supplied from the charge pump CP. The control voltage may be applied to the VCO, and the VCO may generate the plurality of phase signals PS1, PS2, PS3, PS4, and PS5 of which frequency or phase is controlled according to the control voltage.

The phase detector PD and the edge detector ED operate during the same time period and detect the phase of a signal supplied through the data/clock signal line DCSL in the ADP (second period). The phase detector PD detects a phase by comparing the edge of the signal supplied through the data/clock signal line DCSL with the edge of the clock signal CLK. However, when an electrostatic discharge which causes a large phase change beyond one period of the clock signal CLK, the phase detector PD, which compares only the closest transition edges between the clock signal CLK and the DCSL line signal, may not detect that the clock signal has distorted. Further, an edge of the signal supplied through the DCSL line for each bit is not always ensured.

On the other hand, the edge detector ED compares the phase of the first phase signal PS3 instead of the clock signal CLK with the phase of the DCSL line signal. The period of the first phase signal PS3 may be significantly longer than that of the clock signal, and may correspond to that of the unit data block. For instance, the unit data block may have 10 bits in the case of 8-bit pixel data (256 gray scale levels), as but one example.

In some embodiments, the unit data block can always include a transition bit, using an initial bit. With this scheme, the edge of the unit data block can be always ensured.

In addition, as long as there occurs no electrostatic discharge that causes a phase change beyond a plurality of periods of the clock signal, which correspond to the unit data block, e.g., ten periods, the edge detector ED can still detect that the clock signal has distorted (whereby the locking of the clock signal has failed).

Consequently, the phase detector PD continuously adjusts the phase of the clock signal CLK through the voltage controlled oscillator VCO during the second period (and in some cases, during a portion of the first period). In this case, the edge detector ED detects a large distortion of the phase, which is not detected by the phase detector PD due to an electrostatic discharge, etc., and notifies the timing controller 110 of the large distortion of the phase. Thus, the timing controller 110 readjusts the clock signal CLK by re-supplying the clock training pattern CTP.

Figure 5A:
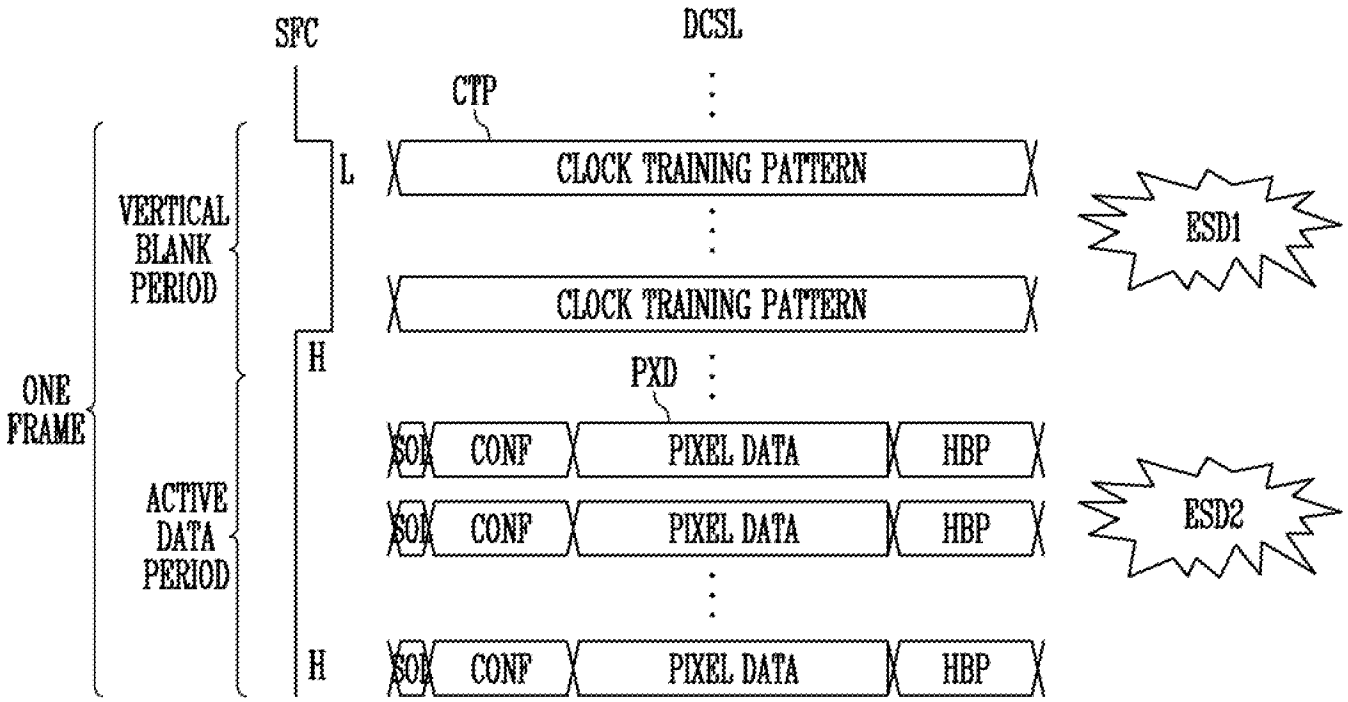
FIG. 5A is a diagram illustrating signals supplied through a data/clock signal line during one frame, under a first phase error condition, according to an embodiment of the inventive concept.

FIG. 5A is a diagram illustrating signals supplied through the data/clock signal line during a single frame (one frame) according to an embodiment of the inventive concept. Here, a single frame refers to a unit period in which the pixel unit 150 displays a still image. Moving images may be displayed through the display device 10 by combining a plurality of frames.

The single frame may generally include a first period (VBP) and a second period (ADP). As described above, the ADP may be a period in which pixel data PXD corresponding to an image to be displayed by the pixel unit 150, and the VBP may be a transitional period in which the pixel data PXD is not supplied.

During the first period, the clock training pattern CTP may be supplied to the data driver 140. The timing controller 110 may supply the SFC signal at a first level (e.g. logic low), thereby indicating to the data driver 140 that the clock training pattern CTP is supplied through the data/clock signal line DCSL. The timing controller 110 supplies the SFC signal at a second level (e.g. logic high) in the second period.

During the second period, a plurality of pixel data PXD and a plurality of data control signals SOL (start of line), CONF (configuration), and HBP (horizontal blanking period) for each active line may be supplied to the data driver 140.

At this time, each active line may correspond to a plurality of pixels PX of a pixel block, which correspond to each of the scan lines S1, S2, S3, S4, . . . , Sn−1, and Sn.

When an electrostatic discharge ESD1 occurs during a period in which the clock training pattern CTP is supplied in the first period, the locking of the clock signal CLK may be performed by the phase frequency detector PFD and the lock detector LD. Lock detecting may be determined according to whether the frequencies and phases of the first phase signal PS3 and the clock training pattern CTP correspond to each other within an error range.

When an electrostatic discharge ESD2 occurs during the second period or a portion of the first period in which the clock training pattern CTP is not supplied, the locking of the clock signal CLK may be performed by the phase detector PD and the edge detector ED. The process of performing the locking of the clock signal CLK is the same as described in FIGS. 3 and 4. In FIG. 5A, it may be assumed that the electrostatic discharge ESD2 only caused a small change in phase between the clock signal CLK and the bits in the unit data block, which is correctable by the phase detector PD, and thus the clock training pattern is not shown provided during the second period. This will be referred to as a first phase error condition.

Figure 5B:
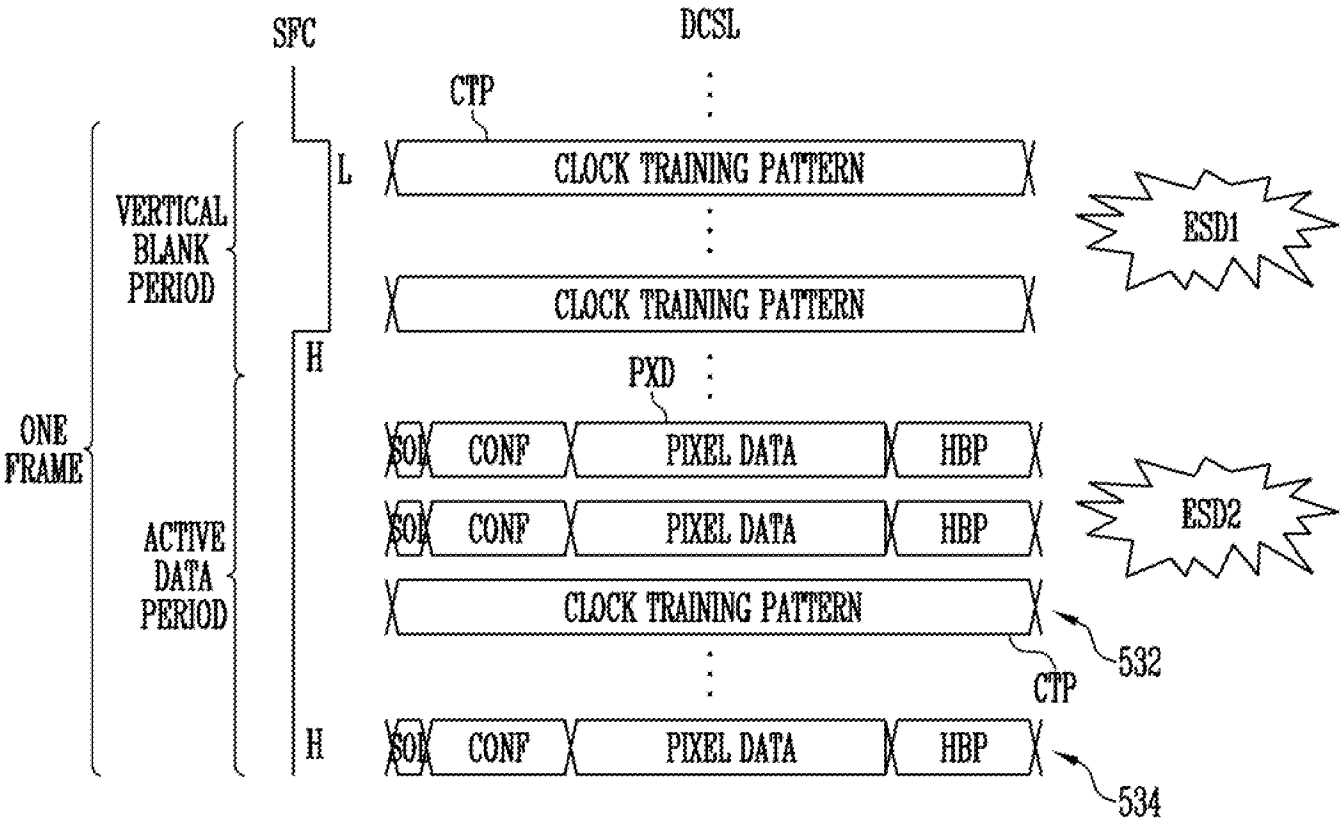
FIG. 5B is a diagram illustrating signals supplied through a data/clock signal line during one frame, under a second phase error condition, according to an embodiment of the inventive concept.

FIG. 5B is a diagram illustrating signals supplied through a data/clock signal line during one frame, under a second phase error condition, according to an embodiment of the inventive concept. This case may be the same as for the scenario of FIG. 5A, except that the second electrostatic discharge ESD2 causes a large change in phase between the clock signal CLK and the bits of the unit data block. In this situation, the edge detector ED detects the large phase change and outputs the feedback signal DSF at a level indicating that the locking of the clock signal has failed. The timing controller 110 responds by suspending the transmission of pixel data and immediately sending a clock training pattern CTP signal, indicated at 532, to the data driver unit 200 that sent the feedback signal DSF (or to all of the data driver units 200). If the data driver unit 200 recovers the clock signal using the CTP signal before the end of the second period, the edge detector ED detects the same and changes the logic level of the feedback signal DSF. The timing controller 110 may then resume sending the pixel data as indicated at 534. Accordingly, in contrast to conventional displays, display 10 according to the inventive concept may recover the clock during the second period and immediately resume pixel data transmission, thereby lessening any visual perception of a display defect.

Figure 6:
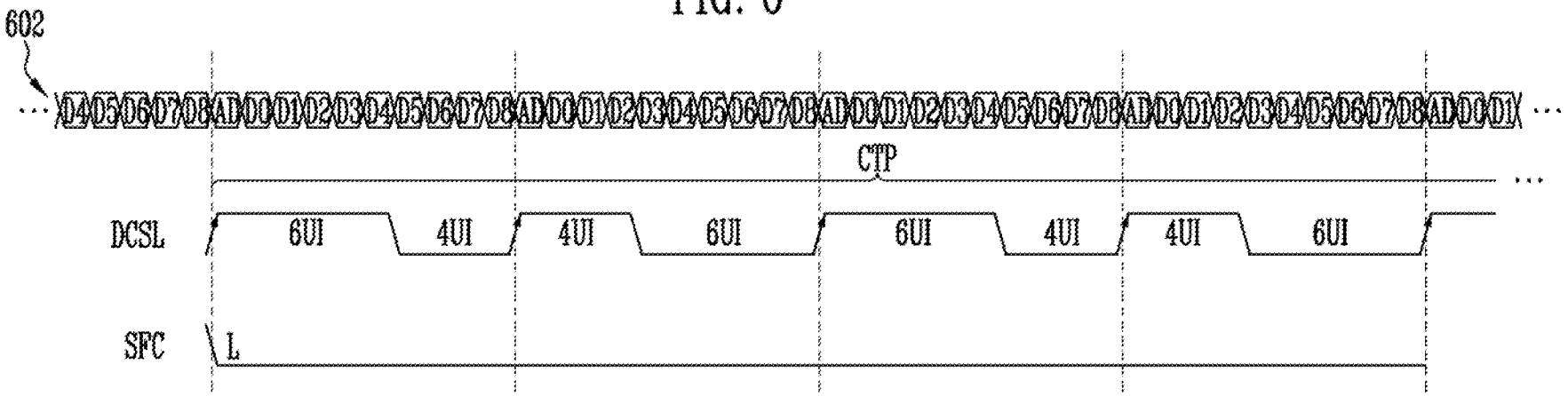
FIG. 6 is a diagram illustrating a clock training pattern according to an embodiment of the inventive concept.

FIG. 6 is a diagram illustrating a clock training pattern according to an embodiment of the inventive concept. Here, an exemplary clock training pattern is illustrated, which has a period spanning ten bits AD, D0, D1, D2, D3, D4, D5, D6, D7, and D8 of a pixel/control data stream 602 (shown in FIG. 6 for comparison), where the ten bits constitute a unit data block. In each unit data block, a ratio of high level to low level repeats 6:4 and 4:6. In other embodiments, these ratios may differ or an alternating pulse width scheme such as that illustrated may not be used. The unit data block may be composed of more or fewer data bits in other examples. The CTP signal is sent over the DCSL line when the SFC signal is at a first level, e.g., logic low.

Figure 7:
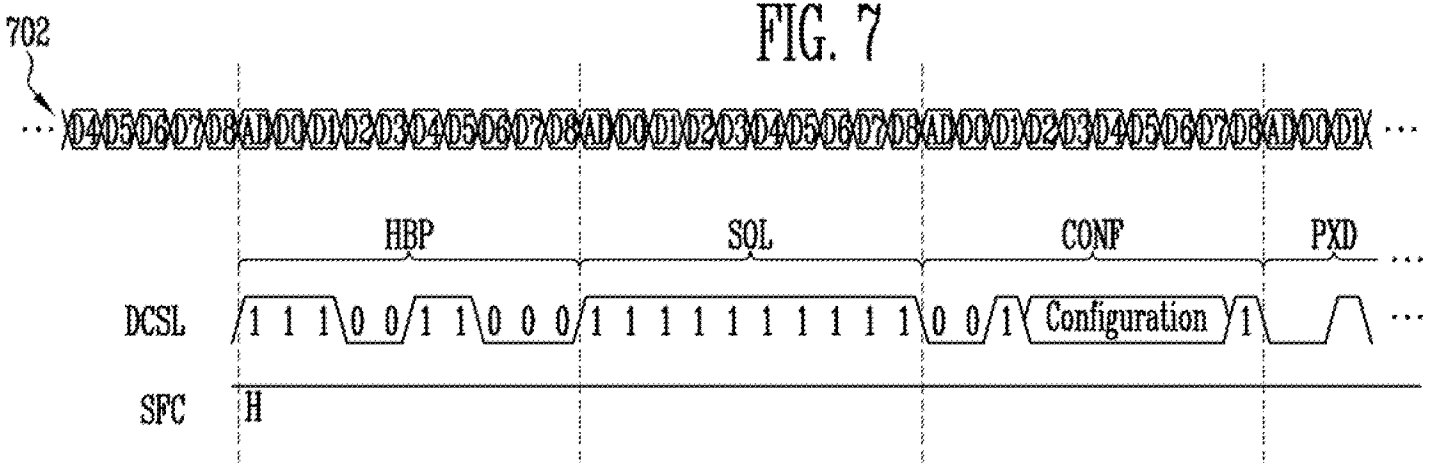
FIG. 7 is a diagram illustrating a plurality of pixel data and a plurality of data control signals according to an embodiment of the inventive concept.

FIG. 7 is a diagram illustrating a plurality of pixel data and a plurality of data control signals according to an embodiment of the inventive concept. As Illustrated, exemplary pixel data PXD and a plurality of data control signals HBP, SOL, and CONF are illustrated, and ten bits AD, D0, D1, D2, D3, D4, D5, D6, D7, and D8 constitute a unit data block of a pixel/control data stream 702. The unit data block includes a transition bit AD. Although the transition bit AD may differ in other embodiments, the transition bit AD may be set to have a level different from that of an immediately previous bit. In other embodiments, the transition bit may be set to have a level different from an immediately following bit with respect to only the pixel data PXD.

The data control signal (horizontal blank period) HBP may notify the driver unit 200 of a transitional period in which the active line is changed. In this embodiment, the unit data block of the data control signal HBP is configured with 1110011000, but any suitable code may be substituted.

The data control signal (start of line) SOL may notify the driver unit 200 of that the supply of a signal through the changed active line has been started. In this embodiment, the unit data block of the data control signal SOL is configured with 1111111111, but any suitable code may be substituted.

The data control signal CONF may define an operation option of the driver unit 200. The operation option may include a power related option, a reverse output related option, and the like. Particularly, in this embodiment, the operation option may include an option for designating a driver unit 200 that is to supply the output signal FLOCK2 of the edge detector ED to the timing controller 110 through the feedback line DSF. Thus, there occurs no collision problem that two or more driver units 200 simultaneously occupy the feedback line DSF. In this embodiment, the unit data block of the data control signal CONF is configured with 001 (operation option), but any suitable code may suffice.

The pixel data PXD may express the gray scale of a pixel corresponding to the other bits D0, D1, D2, D3, D4, D5, D6, D7, and D8 except the transition bit AD of the unit data block. More or fewer pixel bits may be employed to express light according to different gray scales.

Figure 8:
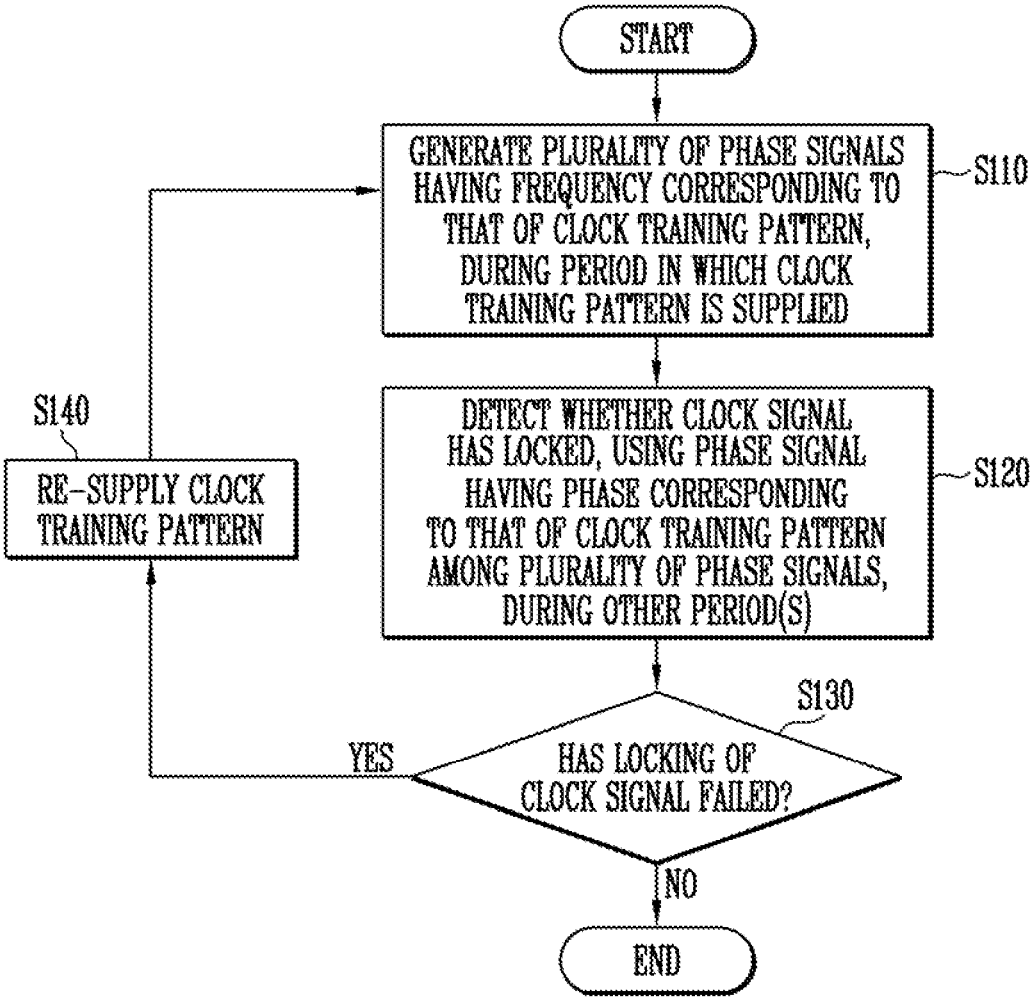
FIG. 8 is a diagram illustrating a driving method of the display device according to an embodiment of the inventive concept.

FIG. 8 is a diagram illustrating a driving method of the display device according to an embodiment of the inventive concept.

First, while the timing controller 110 is supplying a clock training patter CTP, the voltage controlled oscillator VCO of the clock signal generator 310 generates a plurality of phase signals PS1, PS2, PS3, PS4, and PS5 each having a frequency corresponding to that of the clock training pattern CTP (S110).

Next, during one or more second periods in which the clock training pattern CTP is not supplied, the edge detector ED detects whether a clock signal CLK has locked, using a first phase signal PS3 having a phase corresponding to that of the clock training pattern CTP among the plurality of phase signals PS1, PS2, PS3, PS4, and PS5 (S120).

That is, the edge detector ED transfers an output signal FLOCK2 to the timing controller 110 as the feedback signal DSF through the feedback line 142. When the output signal FLOCK2 has a first level notifying that the locking of the clock signal has failed (S130), the timing controller 110 may re-supply the clock training pattern CTP, and the data driver 140 readjusts the clock signal CLK (S140).

In the display device and the driving method thereof according to the inventive concept, a clock signal can be immediately recovered when the locking of the clock signal fails, during not only the vertical blank period but also the active data period.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the inventive concept as set forth in the following claims.

What is claimed is:

1. A display device comprising:

a timing controller configured to supply a clock training pattern through a data/clock signal line in a first period, and supply a plurality of pixel data and a plurality of data control signals through the data/clock signal line in a second period;

a data driver configured to generate a clock signal, using the clock training pattern, in the first period, and generate a plurality of data voltages based on the plurality of pixel data, using the clock signal, in the second period; and a plurality of pixels configured to receive the plurality of data voltages and emit corresponding light, wherein during the second period, the data driver outputs a feedback signal to the timing controller indicating that locking of the clock signal has failed, and the timing controller re-supplies the clock training pattern in response to the feedback signal;

wherein the data driver generates a plurality of phase signals each having a frequency corresponding to that of the clock training pattern in the first period, and generates the clock signal, using the plurality of phase signals.

2. The display device of claim 1, wherein the data driver detects whether the locking of the clock signal has failed, using a first phase signal having a phase corresponding to that of the clock training pattern among the plurality of phase signals in the second period.

3. The display device of claim 2, wherein the plurality of pixel data and the plurality of data control signals are organized in unit data blocks, with a transition bit included for each unit data block, wherein a period of each unit data block corresponds to that of the first phase signal.

4. The display device of claim 3, wherein the data driver detects whether the locking of the clock signal has failed by detecting whether the transition time of the transition bit corresponds to that of the first phase signal.

5. A display device comprising:

a timing controller configured to supply a clock training pattern through a data/clock signal line in a first period, and supply a plurality of pixel data and a plurality of data control signals through the data/clock signal line in a second period;

a data driver configured to generate a clock signal, using the clock training pattern, in the first period, and generate a plurality of data voltages based on the plurality of pixel data, using the clock signal, in the second period; and a plurality of pixels configured to receive the plurality of data voltages and emit corresponding light, wherein during the second period, the data driver outputs a feedback signal to the timing controller indicating that locking of the clock signal has failed, and the timing controller re-supplies the clock training pattern in response to the feedback signal, wherein the data driver includes:

a lock detector coupled to a feedback line carrying the feedback signal during the first period, the lock detector providing the feedback signal during the first period at a level indicative of whether the clock signal has locked; and an edge detector coupled to the feedback line during the second period, wherein the edge detector provides the feedback signal during the second period at a level indicative of whether the clock signal has locked.

6. The display device of claim 5, wherein the data driver further includes a voltage controlled oscillator configured to generate a plurality of phase signals each having a frequency corresponding to that of the clock training pattern in the first period, and to generate the clock signal, using the plurality of phase signals.

7. The display device of claim 6, wherein the data driver further includes:

a phase frequency detector configured to generate a first up signal or a first down signal by comparing at least one of the plurality of phase signals with the clock training pattern; and a phase detector configured to generate a second up signal or a second down signal by comparing the clock signal with the plurality of pixel data and the plurality of data control signals.

8. The display device of claim 7, wherein the data driver further includes a multiplexer configured to selectively output one of an output signal of the phase frequency detector and an output signal of the phase detector according to an output signal of the lock detector.

9. The display device of claim 8, wherein the data driver further includes a charge pump configured to increase the supply of charges according to the first and second up signals output from the multiplexer, and to decrease the supply of charges according to the first and second down signals output from the multiplexer.

10. The display device of claim 9, wherein the data driver further includes a loop filter configured to generate a control voltage according to the supply of charges, wherein the voltage controlled oscillator generates the plurality of phase signals according to the control voltage.

11. A display device comprising:

a timing controller configured to supply a clock training pattern through a data/clock signal line in a first period, and supply a plurality of pixel data and a plurality of data control signals through the data/clock signal line in a second period;

a data driver configured to generate a clock signal, using the clock training pattern, in the first period, and generate a plurality of data voltages based on the plurality of pixel data, using the clock signal, in the second period; and a plurality of pixels configured to receive the plurality of data voltages and emit corresponding light, wherein during the second period, the data driver outputs a feedback signal to the timing controller indicating that locking of the clock signal has failed, and the timing controller re-supplies the clock training pattern in response to the feedback signal, wherein during the second period:

in response to the feedback signal, the timing controller suspends the supply of the plurality of pixel data and the plurality of data control signals and re-supplies the clock training pattern;

the data driver re-generates the clock signal based on the re-supplied clock training pattern and outputs the feedback signal at a different voltage level back to the timing controller, the different voltage level representing that the locking of the clock signal has succeeded; and the timing controller resumes the supply of the plurality of pixel data and the plurality of data control signals in response to receiving the feedback signal at the different voltage level.

12. The display device of claim 1, wherein the first period is a vertical blanking period (VBP) of a frame and the second period is an active data period (ADP) of the frame.

13. The display device of claim 12, wherein the timing controller re-supplies the clock training pattern in response to the feedback signal during the active data period.

14. A method for driving a display device, the method comprising:

in a first period, supplying, by a timing controller, a clock training pattern through a data/clock signal line, and generating, by a data driver, a clock signal using the clock training pattern, which comprises generating a plurality of phase signals having a frequency corresponding to that of the clock training pattern in the first period, and generating the clock signal using the plurality of phase signals;

in a second period, supplying, by the timing controller, a plurality of pixel data and a plurality of data control signals through the data/clock signal line, and generating, by the data driver, a plurality of data voltages based on the plurality of pixel data using the clock signal; and supplying the plurality of data voltages to a plurality of pixels to emit light corresponding to the plurality of data voltages, wherein during the second period the data driver outputs a feedback signal to the timing controller on a feedback line, the feedback signal indicating whether locking of the clock signal has failed, and re-supplying, by the timing controller, the clock training pattern upon receiving the feedback signal in a state indicating the locking of the clock signal has failed.

15. The method of claim 14, further comprising detecting whether the locking of the clock signal has failed, using a first phase signal having a phase corresponding to that of the clock training pattern among the plurality of phase signals in the second period.

16. The method of claim 15, wherein the plurality of pixel data and the plurality of data control signals are organized in unit data blocks, with a transition bit included for each unit data block, wherein a period of each unit data block corresponds to that of the first phase signal.

17. The method of claim 16, wherein the data driver detects whether the locking of the clock signal has failed by detecting whether a transition time of the transition bit corresponds to that of the first phase signal.

18. Display device circuitry comprising:

a timing controller circuit configured to supply a clock training pattern through a first signal line during a vertical blanking period of a frame, and supply a plurality of pixel data through the first signal line during an active data period of the frame; and a data driver circuit configured to generate a clock signal, using the clock training pattern in the vertical blanking period, and generate a plurality of data voltages to be output to a plurality of pixels, based on the plurality of pixel data using the clock signal;

wherein during the active data period:

when there is no electrostatic discharge that causes locking of the clock signal to fail in a manner uncorrectable by the data driver circuit, no clock training pattern is supplied by the timing controller circuit after initiation of the supply of the plurality of pixel data; and when an electrostatic discharge causes locking of the clock signal to fail in a manner uncorrectable by the data driver circuit, the data driver circuit outputs a feedback signal to the timing controller circuit indicating the locking of the clock signal has failed, and the timing controller circuit re-supplies the clock training pattern in response to the feedback signal.

19. The display device circuitry of claim 18, wherein during the active data period, when there is no electrostatic discharge that causes locking of the clock signal to fail, the timing controller circuit supplies, for each of a plurality of active lines, start of line (SOL) data control signals at the beginning of the active line, followed by configuration control data and pixel data, wherein a period of the pixel data is followed by a horizontal blanking period.

* * * * *